US012285670B2

(12) United States Patent
Martinez

(10) Patent No.: US 12,285,670 B2
(45) Date of Patent: Apr. 29, 2025

(54) GOLF SWING TRAINING DEVICES, SYSTEMS AND METHODS

(71) Applicant: The Golf Boks LLC, Beaverton, OR (US)

(72) Inventor: Sebastian Martinez, Beaverton, OR (US)

(73) Assignee: The Golf Boks LLC, Beaverton, OR (US)

( * ) Notice: Subject to any disclaimer, the term of this patent is extended or adjusted under 35 U.S.C. 154(b) by 0 days.

(21) Appl. No.: 17/799,665

(22) PCT Filed: Feb. 14, 2022

(86) PCT No.: PCT/US2022/016349

§ 371 (c)(1),
(2) Date: Aug. 13, 2022

(87) PCT Pub. No.: WO2022/186977

PCT Pub. Date: Sep. 9, 2022

(65) Prior Publication Data

US 2024/0189691 A1 Jun. 13, 2024

Related U.S. Application Data

(60) Provisional application No. 63/157,588, filed on Mar. 5, 2021.

(51) Int. Cl.

| | |
|---|---|
| ***A63B 69/36*** | (2006.01) |
| ***A63B 71/02*** | (2006.01) |
| *A63B 71/06* | (2006.01) |

(52) U.S. Cl.

CPC ..... *A63B 69/3621* (2020.08); *A63B 71/023* (2013.01); *A63B 2071/0694* (2013.01); *A63B 2210/50* (2013.01)

(58) Field of Classification Search

CPC ..... A63B 69/3621; A63B 71/023; A63B 2071/0694; A63B 2210/50

USPC ..... 473/218, 257, 262, 266, 268, 270, 272, 473/278, 279

See application file for complete search history.

(56) References Cited

U.S. PATENT DOCUMENTS

| | | | | |
|---|---|---|---|---|
| 3,097,437 A | | 7/1963 | Harrison | |
| 3,198,339 A | * | 8/1965 | Stolarz | B42D 5/043 211/69.5 |
| 3,279,648 A | * | 10/1966 | Worthington | B65D 71/004 206/517 |
| 3,428,235 A | * | 2/1969 | Randazzo | B65D 71/36 206/427 |
| 3,690,620 A | * | 9/1972 | Matson | E01F 9/688 256/64 |

(Continued)

OTHER PUBLICATIONS

International Search Report and Written Opinion for PCT Application No. PCT/US2022/016349, mailed May 3, 2022, 9 pages.

*Primary Examiner* — Nini F Legesse
(74) *Attorney, Agent, or Firm* — Ganz Law, PC

(57) ABSTRACT

A golf training device that includes a planar element that is formable into one or more forms having 3 or more sides using one or more respective sets of crease or fold lines associated with the planar element and defining the sides; and one or more support means for supporting one or more alignment sticks or markers, the support means arranged to orient the alignment sticks or markers in position useful for golf training.

19 Claims, 18 Drawing Sheets

(56) References Cited

U.S. PATENT DOCUMENTS

| | | | | |
|---|---|---|---|---|
| 4,383,687 | A * | 5/1983 | Wolff | A63B 69/36<br>359/872 |
| 4,607,784 | A * | 8/1986 | Calabrese | A47C 5/005<br>297/188.1 |
| 6,500,075 | B1 * | 12/2002 | McDevitt | A63B 69/3621<br>473/270 |
| 8,109,837 | B1 * | 2/2012 | Khananayev | A63B 69/3614<br>473/220 |
| 2005/0143185 | A1 * | 6/2005 | Cowup | A63B 69/3629<br>473/268 |
| 2007/0015597 | A1 * | 1/2007 | Bush, III | A63B 69/3621<br>473/270 |
| 2015/0238838 | A1 | 8/2015 | Malamitsas | |
| 2016/0107061 | A1 * | 4/2016 | Turk | A63B 69/3621<br>473/266 |

* cited by examiner

GOLF SWING TRAINING DEVICES, SYSTEMS AND METHODS

BACKGROUND

The inventive subject matter relates generally to golf-swing and posture training devices, systems and methods, and related shipping containers used with the devices.

Alignment devices like stick and pool noodles are known for use in developing golf swings and posture. Currently, there are a number of solutions for holding up alignment sticks and pool noodles for such training purposes, including the most cumbersome of which is an instructor physically holding them for a student golfer. The alignment devices are positioned so that they give the golfer visual and negative feedback to change their golf swing and postural elements like stance. Some of these solutions attempt to be versatile but fail to meet the needs of the industry because they only provide a couple of uses or angles, cannot be used indoors and outdoors, are tough to transport, or challenge the user to understand the variety of potential uses and how to adjust the alignment device for different shots or clubs. Other solutions attempt to easily fit in a golf bag and be portable. But these solutions are similarly unable to meet the needs of the industry because they are too expensive to manufacture, resulting in devices that do not easily sell, or when made with reduce cost, break easily, holding alignment sticks in only a few directions, either a plane angle or an alignment to target, or they are only able to use one alignment stick at a time. Still, other solutions seek to provide a multitude of uses but these solutions also fail to meet industry needs because they are too cumbersome, still too expensive, are not portable, and are expensive to ship.

It would be desirable to have a golf swing training apparatus that holds alignment sticks and other marker like rods and hollow tubes, e.g., foam pool noodles in a variety of angles and alignment configurations, which can be used indoors or outdoors, are lightweight and easy to transport.

Furthermore, it would also be desirable to have a device that can be configured for left and right-handed golfers, of most heights, to use for all aspects of golf from driving, iron play, short game, and putting.

Still, further, it would be desirable to have a device that is inexpensive to manufacture and ship, which can be made flat for transport or folded into a shipping container for other products and training aids so that it can cut down on the cost and footprint of shipping.

Therefore, there currently exists a need in the industry for a device that can, for example, perform the function of many other training aids, with lots of adjustability, is portable, can be used indoors or outdoors, is inexpensive to manufacture and ship so as to have a large portion of the golfing population invest in it.

Similarly, it would be desirable to have an associated shipping container and method to ship training aids like alignment rods and foam noodles to golfers, or other products, which is environmentally friendly and can be reused in conjunction with the shipping container to supplement the shipped training aids. Therefore, a need exists in the industry for a shipping container and process that delivers golfers their training aids or other products and then uses the package to help golfers improve their golf swing, posture, and game.

SUMMARY OF THE INVENTION

The inventive subject matter is generally directed to golf training devices, systems and methods, and related shipping containers that may service as a training device and which may support other training devices.

The inventive subject matter is more particularly directed to a golf training device that includes a planar element that is formable into one or more predetermined 3D forms using one or more respective sets of crease or fold lines associated with the planar element; and one or more support means for supporting one or more other training devices, particularly alignment sticks or markers, the support means arranged to orient the alignment sticks or markers in position useful for golf training. Advantageously, the aforementioned training device can be reversibly configured as a shipping container.

In certain non-limiting embodiments, the inventive subject matter is directed to a golf swing training apparatus, which ships alignment sticks/rods and pool noodles and is able to support them in varying positions to provide feedback for golfers practicing all aspects of their golf game. The devices allow a golfer to practice the selected swing mechanics to facilitate learning of an optimal golf swing and with optimal body movement. The devices may also have graphic elements like instructions and visuals on it to further facilitate improvement. The devices can be used indoors or outdoors and hold alignment sticks/rods vertically, horizontally, or at a variety of angles and spacings for many different training settings.

In certain embodiments, the inventive subject matter is directed to a device in the nature of a planar structure made of one or more sheets of material. The structure may have multiple preformed holes or cutouts for holes, so that when the planar structure is folded into a geometric shape, a user can insert alignment sticks or other elongated rods or shafts into and set them up in a variety of different configurations.

The material(s) may be a rigid or semirigid sheet material that have sufficient flexibility and rigidity to serve the functions contemplated herein. For example, a sheet material may be cardboard, corrugated sheets, wood, plastic, leather, fabric, fiberboard, foam board, glass, acrylic, paper, metal, or other similar semi-flexible and relatively rigid materials. The planar structure can be a unitary structure, or it can be a modular structure where several sub-structures are connected to form an integrated, full planar structure. For example, different substructures could represent different faces in an assembled, 3D structure.

Once the planar structure or substructures are folded or assembled into a predetermined 3D geometrical shape, the hinge or joint lines may be glued permanently to fix the structure. Or the structure can be reversible so that it is able to be made flat again using for example releasable tabs of flaps or other means of interlocking pieces or fastening means like hook and loop fasteners.

In certain embodiments, the planar structure includes fold lines or living hinges so that it can be reversibly flattened or folded up and used as a shipping or display container for other training aids or other products, such as alignment sticks/rods, foam noodles, putting mirrors, hats, towels, shirts, shoes, balls, tees, bags and other retail merchandise and then converts into the training apparatus.

The device may also have one or more of the following features or attributes: (1) sides that fold up and include holes configured to orient alignment devices in one or all of horizontal, vertical, or diagonal directions compared to the line of play in golf; (2) padding, or additional layers on any of the faces; (3) hinge mechanisms, e.g., fold lines or living hinges to create the folds that will turn the planar structure into a predetermined geometrical shape(s), such as triangular, square, rectangular, pentagonal, cylindrical, circular, spherical, prisms of all shapes, and other shapes formable by folding a planar structure; (4) holes or cutouts that are shaped to allow the use of objects other than cylindrical alignment sticks, for example metal rods, foam, wooden dowels, golf shafts, rulers; (5) graphic elements like visuals, art, or graphics on any of the inner or outer faces for shipping, golf instruction, or marketing; (6) locking mechanisms to adjust the planar structure into a predetermined planar shape, including flaps, tabs, holes to receive and secure alignment sticks or golf tees, magnets, clips, ties, string, hook and loop fasteners (e.g., Velcro™, etc.; (7) holes and planes in a predetermined geometric shape that are arrange to create any or all angles from 0 to 180 degrees; and (8) a waterproof, water resistant, or porous exterior and/or interior surface.

Similarly, the associated method may also include one or more of the following steps: (1) shipping any training aid or product in the device, which products could be alignment sticks, foam noodles, towels, tees, hats, head covers, merchandise, apparel, gloves, sports balls, shoes, golf putting or full swing mirrors, inflatables, bags including golf bags, and backpacks, ball markers, ball mark repair tools, alignment stick covers; (2) displaying any training aid or product in the device; (3) training golfers to improve their golf swing or posture by using the device, writing on the device, creating videos or a website of how to use the device; and (4) shipping, delivering, displaying or distributing any number of alignment sticks and pool noodles in the device.

The disclosed device is unique when compared with other known devices and solutions because it provides: (1) uses for all golf clubs in the bag, including putter, driver, woods, irons, and wedges at varying plane angles for each, ranging from 0 degrees to 180 degrees; (2) the ability to help align a player in different orientations and degrees to the target, left, right, straight, while simultaneously showing the correct planes for the club, as well as simultaneously helping with ball positions and stance width for all the clubs; (3) graphic elements that help golfers with ball position, shaft lean, stroke length, angle of attack, club path, as well as provide instruction on how to use the device; (4) a structure that is inexpensive and fast to manufacture; (5) a flat shippable structure; (6) an eco-friendly structure that can be made from recycled materials, and which is recyclable; (7) a lightweight structure; (8) a structure that is modular in that it can be connected to others of the same or similar device so as to create additional uses; (9) a device that is usable by left and right handed golfers; (10) a device that can be used indoors, outdoors, on grass, carpet, synthetic turf, concrete, sand etc.; (11) a relatively inexpensive enough that instructors can provide to their students to take home after a lesson; (12) a markable device that cab written on or otherwise marked with useful information, for example annotations to help a golfer remember the prescribed way for them to use the device; (13) a device that functions as a shipping container and which can be converted into reused a training device, which is therefore more environmentally friendly than a normal, discardable shipping container; and (14) a device that is customizable with graphic elements in the nature of marketing or promotional messages or information so as to provide marketing opportunities for the companies using the product as a shipping container, or displaying products at their retail location, or distributing products at events or outings.

Similarly, the disclosed method is unique when compared with other known processes and solutions in that it: (1) uses the device to ship itself or other training aids including alignment sticks and foam noodles to the customer or golfer; and (2) serves as a shipping container that converts or transforms into a training aid and, vice versa, can convert or transform back into a container form or flat form.

The disclosed device is unique in that it is structurally different from other known devices or solutions. More specifically, the device is unique due to the presence of (1) a planar structure that can be folded to create a shipping container and also a training aid able to support alignment sticks in predetermined positions; and (2) the device can be made from a lightweight, even recyclable material, that is quickly and efficiently manufactured.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The inventive subject matter may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

Figure 1A:
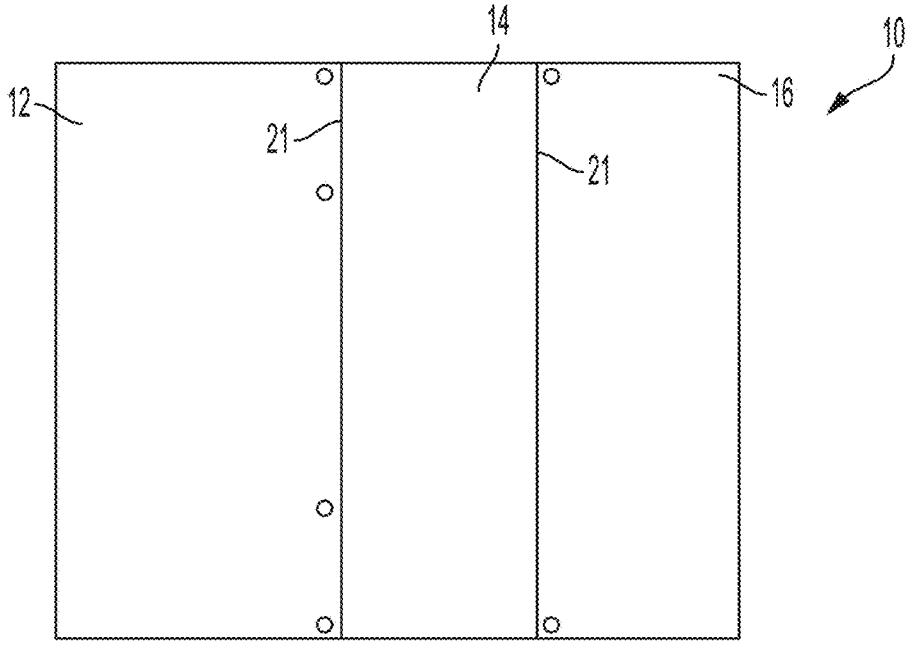
FIGS. 1A-1E show a device in a flat top view, as wells side views showing the changing angle of the device plane and an angled side view with the device holding up an alignment stick and pool noodle.
Figure 1B:
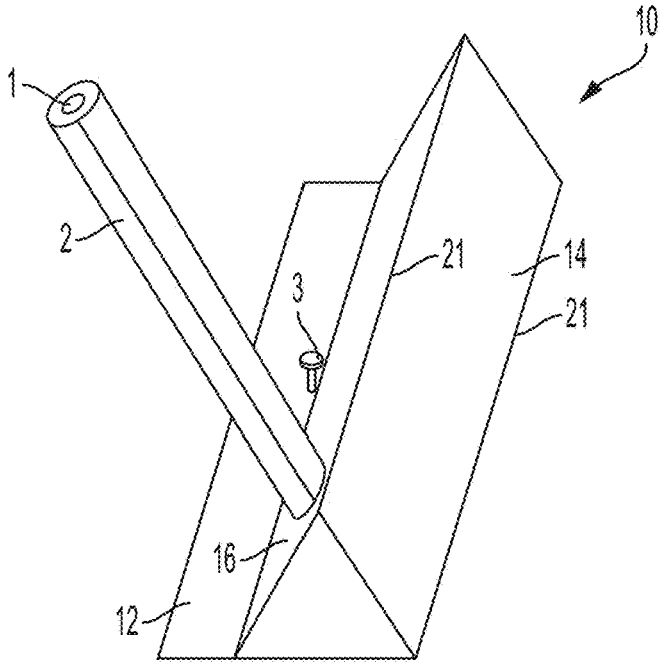
Figure 1C:
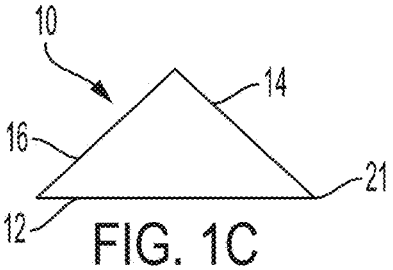
Figure 1D:
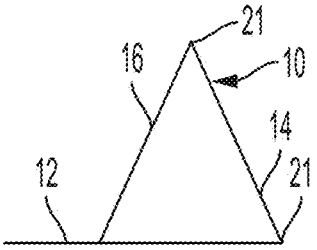
Figure 1E:
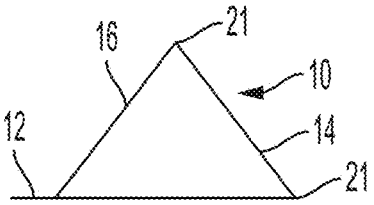

The inventive subject matter is directed to a golf-swing training devices, systems and methods.

In certain embodiments, a device includes a 3D configuration with one or more angled faces, which may be angularly adjustable. One or more of the faces or other portions of the device may be configured to support alignment markers or sticks in one or more standard angles for any one or more kinds of clubs used in golf. As discussed below, the alignment marker or stick may be supported on the device using apertures or holes that removably secure the stick or marker to the device in a predetermined or desired fixed position. Other support means may include fasteners like clips or clamps, hook and loop fasteners, magnets, etc.

As examples, the standard angles at which the sticks or markers are fixed may be based on the static lie angle of the golf club as defined by the hosel and shaft of the club at address compared to the ground, and some deviation from average for flatter or steeper angles based on a player's custom club fitting and body anatomy. The standard angle for a driver or wood is 45 degrees, but can range down to 35 degrees for juniors, flat swings, shorter individuals, and up to 50+ degrees for taller individuals and upright swingers. The standard lie angle for irons differs based on the length of the iron, as longer irons are flatter 50-55 degrees, and shorter irons or wedges are more upright 55-65+ degrees. The standard lie angle for a putter may range from 65-80 degrees based on the player, putter, or putting stance adopted. All of these angles are achievable with the device.

Utilizing multiple devices at once, a player may set one device below his shaft at address at the flat end of the range, and a second device outside of the toe of his club at address at the steep end of the range for that particular club. This creates a guide channel that defines a travel path for the shaft or club head between the steep and flat range for that particular club. For example, a driver could have a flat plane alignment marker setup at 40 degrees, and a steep alignment marker at 50 degrees, with a preferred angle channel of 45 degrees being created in between the two alignment sticks.

Using these angles, settings of the device can be used, for example, to point alignment sticks at different heights for identifying body motion. That includes angles low enough to point an alignment stick at the shin, or high enough to position the alignment stick beside a player's head based on the player's individual anatomy. Other angles that can be used in golf would be an angle between 80-90 degrees to allow a stick to be placed directly outside a player's lead or trail foot to help with the setup and movement of the player's hips throughout the swing.

Additionally, when used for alignment with the target, the device may include alignment stick apertures 18 that allow for alignment markers to be set up at varying levels of left or right in comparison to the target. For instance, it may be beneficial for players to understand what 3, 5, and 10 degrees left or right deviation from a target looks like. This allows players to know among many things: how open or closed a clubface is at setup, how wide of a field goal to create for their ball's launch direction, or how much to change their stance alignments and swing direction to create varying levels of curvature with their ball flight.

In one possible embodiment, an alignment device includes a main planar structure that is formed of or cut out of a flat piece of material, e.g., a corrugated sheet material like cardboard used for shipping packages, with optional graphics printed on it. When folded up along predefined creases made in the sheet material, the sheet material forms into a three-dimensional shape having one or more planar faces. The 3D form could be made from a single piece of sheet material with fold lines or creases that define a predetermined shape. Or it could be formed of multiple pieces of sheet material that are joined together. In some embodiments, multiple fold or crease lines 21 are defined in the sheet material such that a user can select multiple different predetermined 3D forms. The sets of lines could be coded to indicate a given predetermined 3D form. For example, a set of blue lines could indicate a triangular prism; a set of red lines could indicate a square, rectangle or other polygon; a set of green line(s) could indicate a tubular or other curving shape. Similarly, other line sets could indicate that a given shape can be formed in varying dimensions.

In a representative embodiment, the 3D form may be a triangular prism but it may be other shapes, as indicated elsewhere herein.

The 3D element may hold its shape due to engagement or attachment features, which may also be referred to as "engageable elements". The engagement elements may help hold the device as a closed container for shipping merchandise in the device. They also may adjustably allow for movement of a predetermined plane face into predetermined or desired plane angles. They may also provide structural integrity to the device that allows it to hold a particular 3D shape.

As illustrated in the Figures, the engagement elements may be elements like tabs or flaps 20 that are integrally part of the planar element. They may matingly engage with holes or slots that may be preformed in the planar element or are formed in the planar element between adjacent folded or bent portions of the planar element. The tabs or flaps are received in a hole or slot and are configured so that there is an abutment or impingement with a surface or surfaces on an opposite side that blocks or otherwise secures the flap or tab from retreating back through the hole or slot. In other embodiments, the engageable elements may engage with another engageable element or section of the device to provide bracing or support in the assembled device.

The engageable elements need not be integrally formed with the planar element, they could be a separate structure that interconnects sections of the planar element's sheet material or separate pieces of sheet material that that are joined to form a planar element. For example, alignment sticks, and tees could interconnect sections of a planar element. Alternatively, the sections of a planar structure or structure could be interconnected using standard bonding or fastening means like, clips, staples, male/female engageable elements, e.g., snap fasteners, tape, rivets, glue or other bonding agents, screws or nuts/bolts, adhesives, etc. In some embodiments, the engagement elements or other attachment features may be disengageable so that the main planar element or elements can reversibly be made flat again.

In some embodiments, the 3D shape of the device could be held based on use of malleable a material like relatively thin aluminum sheeting. In such cases, the device may not need any engagement features other than the inherent malleability and rigidity of the material. In other embodiments, different pieces of sheet planar sheet material could be interconnected by multi-axial clips wherein a given clip has two or more receiving slots that each receive a piece sheet material at a different angle. For example, an equilateral prism could be formed using corner clips each having slots offset at 60 degrees.

Using a triangular prism as a non-limiting representative example, the left and right sides of the triangular prism are parallel to each other. The bottom side of the prism lays flat on a support structure such as the ground. The angle created by the top sides of the triangular prism is adjustable so as create different angles for the shaft plane of the apparatus, or varying planes and degrees of the alignment sticks inserted through the holes in the top and bottom faces of the shaft prism. The prism has tabs that close the interior off so that other products are placed in it for storage and shipping purposes. The planar element without folding is flat so as to ship multiple together in a stack/bundle/pallet without holding a product inside them.

The planar element may include a plurality of holes or cutouts for holes 18 that are sized, shaped and arranged to fixedly receive and hold a standard shaped/sized alignment stick in one or more desired positions used in golf training. The holes may be fully formed through holes. Or they may be partially formed, e.g., not fully punched out during manufacturing so as to provide better protection for products when shipped. They may be punched out by the golfer to provide a desired alignment stick configuration. Or they may simply be graphical markings that a user cuts out to create a hole.

There may be holes 18 on a first section in a first plane that are alignable with holes 18 in a second or additional sections in different plane(s) so that when an alignment stick goes through them, they define a positioning of the alignment stick. The holes may define a stance position, a position for alignment of a ball and/or an alignment of a club relative to a ball position. The holes may be angled so that sticks placed in the holes define a guide channel for swinging a club relative to a target and/or a ball position. The holes may define vertical or horizontal angles or any angle in between. When placed in the holes, the alignment sticks can help a player do any one or more of the following: identify ball position, stance width, stroke length, swing low point, as well as connect multiple alignment assistance devices together and provide additional leverage for the device.

In the examples illustrated in the Figures, the left and right sides of the triangular prism have holes in them for alignment sticks to go through to align at the target, help with face angle direction, point left or right of the target by different angles based on which holes the alignment stick is put through, connect multiple devices together, and connect one device at an offset angle from another one.

As illustrated in certain Figures, there are also holes on these faces to hold an alignment stick at a raised level so as to show a player whether his eyes are over top of the ball in putting, have his shaft slide on to show a plane when putting, or help a player with head movement during all shots.

Also, as illustrated in certain Figures, the top and bottom faces of the prism have holes in them to create a shaft plane, a shoulder plane, hand plane, hand path, a slot for the clubhead and shaft to go through during the backswing and downswing, or place an alignment stick in a position where it can provide feedback for the players hip, knee, lower body, torso or head motion.

The bottom of the prism has optional graphics that indicate a golf parameter. For example, the graphic may indicate where to insert a tee so as to lock in the different angles between the top two sides, which create the face of the plane board.

In a representative embodiment, the dimensions of the device include a length sufficient to fit conventional or specialized alignment sticks and foam noodles inside for shipping. The faces of the device contain graphics to help the player with golf parameters like ball position, shaft lean, putting stroke length, club path, angle of attack, instruction on how to use the device, which angles to use for different ball flights, which angles to use for different clubs, website & social media information, a place to attach a shipping label, logos of the brand and affiliates, marketing, charities, and a place for instructors to write personalized instruction for students. The graphics may be printed during the manufacturing process and may help provide water resistance to the packaging. For example, the graphic can be a durable plastic or other polymer film or coating on some or all the surface of the planar element. The device may hold any kind or product for use by purchaser or for displaying the product in a retail setting.

These components are related where the holes are in the face of the flat corrugate plane, where the cutout shape is able to be folded into a self-supporting triangular prism and the holes in the corrugate create a support structure for alignment sticks/rods which can hold foam noodles to be held in all the positions previously listed, and are able to connect with multiple of the devices to create even further training combinations.

One possible method according to the inventive subject matter consists of the following two or more of the following steps, with different permutations possible: A customer orders a product, e.g., alignment sticks, foam noodles, and an alignment stick cover. The products, e.g., the alignment sticks, foam noodles, and alignment stick cover are shipped to the customer in the device as the shipping container. The golfer, instructor or other user uses alignment sticks by inserting them through the holes of the device in a predetermined arrangement in the device that encourages a desired stance, movement and/or change in the swing. Accessory components like foam noodles may be added to the device or alignment sticks. For example, hollow foam tubes (e.g., like pool noodles) may be placed on some of the alignment sticks as desired. The golfer trains with the assembled device.

The Figures described below are merely exemplary and are not intended to exhaustively indicate all possible embodiments of the inventive subject matter contemplated herein.

FIG. 1 shows multiple views (FIGS. 1A-1E) of a triangular prism version of the device 10 having side sections 12 (bottom), 14 (back), 16 (front). Included are the device laid out flat FIG. 1A, a perspective view of the device folded into one possible prism form (FIG. 1B) and three different fold options in side view cross sections of the device, with the version in FIG. 1D matching to FIG. 1A. The different side views help illustrate how the device would alter the angles of the plane board and holes that hold up alignment sticks. The perspective view of the device 10 holding up an alignment stick 1 and foam noodle 2 with a lock element, e.g., golf tee or other stick-like structure inserted in an aperture through one side section 16 (not shown) in a first plane and into another aperture in second side section 12 in another plane, which locks the sides into a prism shape. Multiple holes may be provided in a section, e.g., bottom section 12 to vary the plane angle of another section, e.g., front section 16.

FIGS. 2A-2E show multiple views of a triangular prism version of the device 10. This version also includes a plurality of engageable elements, namely tabs 20, that extend from the main, rectangular body of the device (as seen in FIG. 1) and engage with each other and/or the box so that the box holds a predetermined configuration, in this case a triangular prism. Such tabs are known or designable by persons skilled in the art and therefore are not discussed in detail herein The tabs 20 are shown in a variety of sizes, shapes and positions. Some tabs include subtabs. Different sections of them main body of the device can fold along fold lines 21, and similarly, sub-tabs within a tab can fold along fold lines 21. The fold lines 21 can have different lengths and positions. They can be represented by printed lines, partial cutouts, or creases on or in the device. (For the sake of avoiding cluttering the Figures, only representative tabs and fold lines are labeled in the Figures.)

Figure 2A:
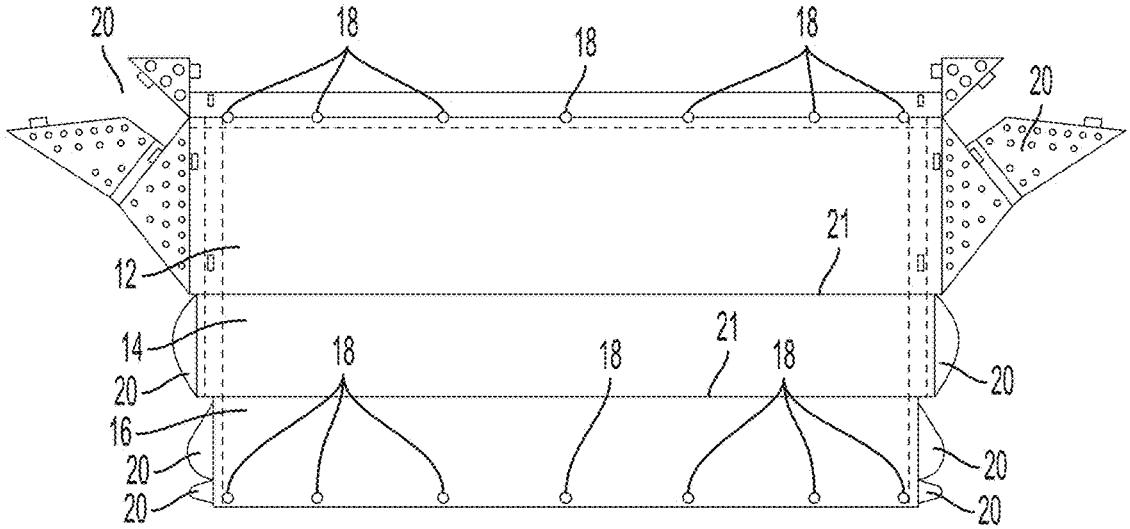
FIGS. 2A-2E show a device in triangular prism form with a flat top view, a front angled view with graphics on the device, two side views with shipping form and holes, and a front view with the device having an adjusted plane angle while holding alignment sticks, foam noodles, and another alignment stick for support and ball position.
Figure 2B:
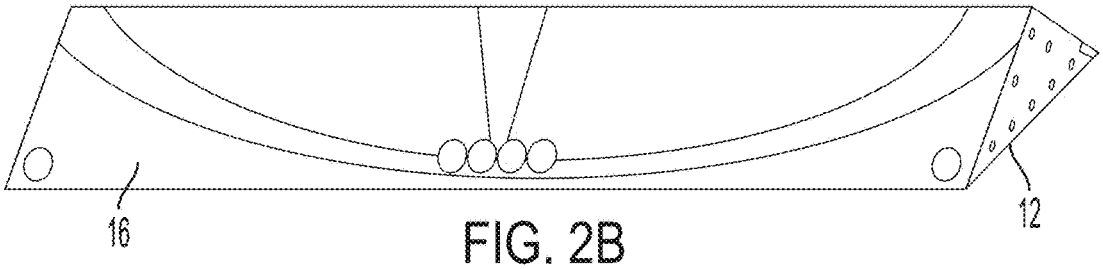
Figure 2C:
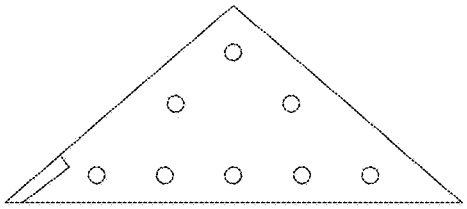
Figure 2D:
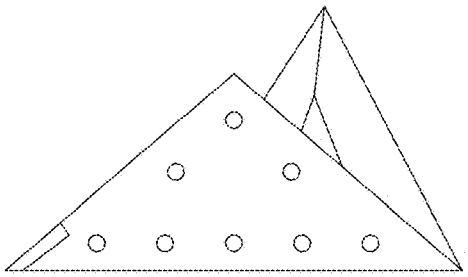
Figure 2E:
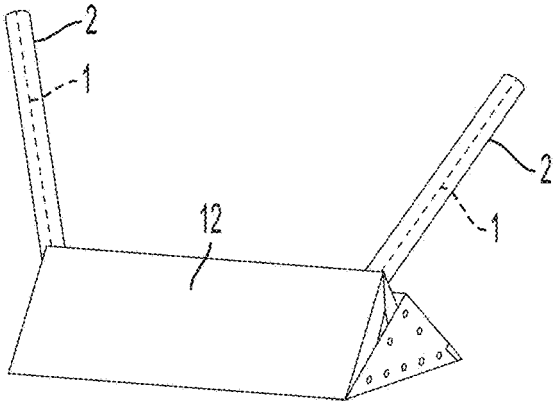

There is a top view of the device laid out flat FIG. 2A. This top view includes holes 18 for inserting alignment sticks or other structures for ball position, shaft plane, hand path, putting plane, head motion, eye position, alignment, attaching multiple devices together, stroke length, and all uses detailed in the attached descriptions. There is a front angled view FIG. 2B that shows the device in closed shipping container form with graphics on the surface of the device. There are two side views of the device (FIGS. 2C, 2D), one shows the device in closed form (FIG. 2C), and the other one (FIG. 2D) shows the device with the plane adjusted for a higher angle of plane board and alignment stick holding. There is a front perspective view of the device in training aid form holding up two alignment sticks 1 and foam noodles 2 to provide an extended plane board (FIG. 2E).

Figure 3A:
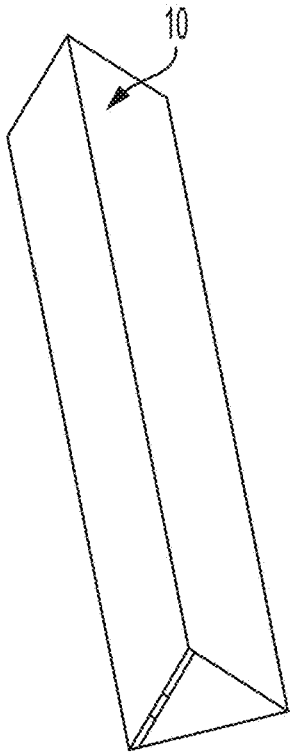
FIG. 3A-3B show a device both in closed shipping container form and as an open shipping container with foam noodles and alignment sticks stored inside of it.
Figure 3B:
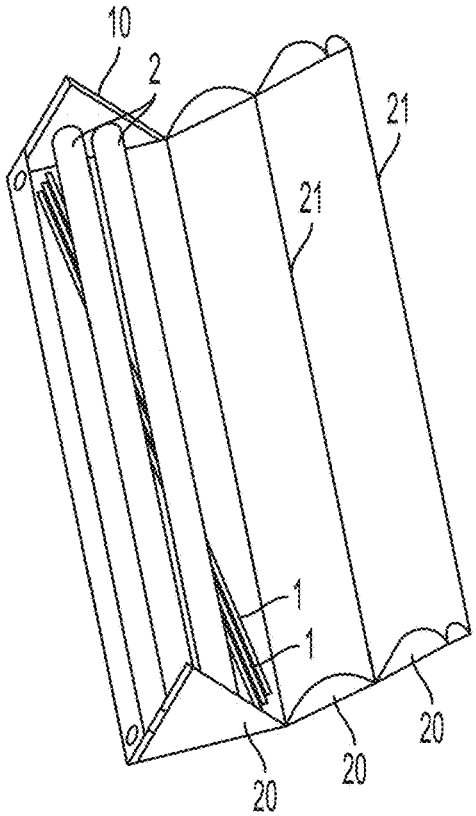

FIGS. 3A-3B show the device 10 in closed shipping form (FIG. 3A), and then the same device shown open (FIG. 3B) and revealing its contents, which are foam noodles 3 and multiple alignment sticks 2 fitting inside of it.

Figure 4A:
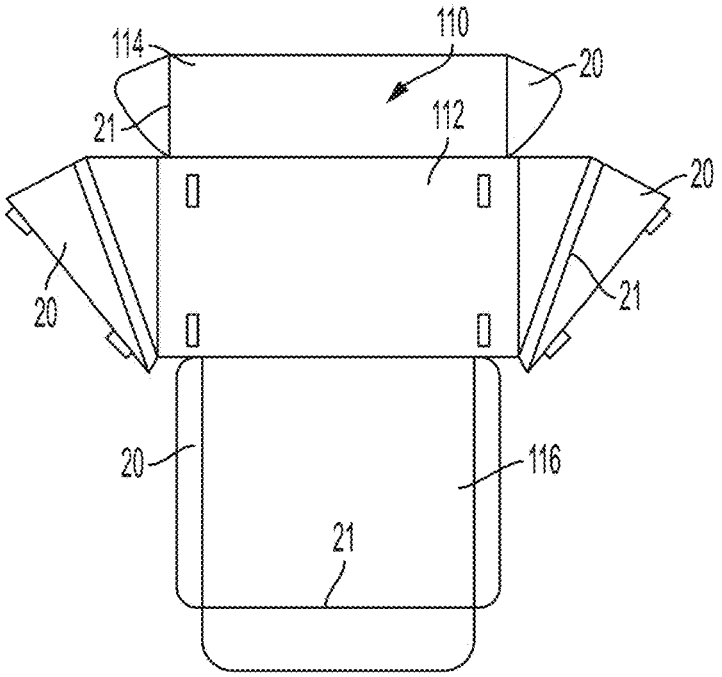
FIGS. 4A-4E show an alternative sized and shaped device that is meant for a putting plane board. This figure includes a top flat view of the device, an angled side view of the device in closed form, a side view of the different angles of the device, a front angled view with the device in training aid for, and a front angled view of the device open in shipping container form holding a putting mirror and golf balls.
Figure 4B:
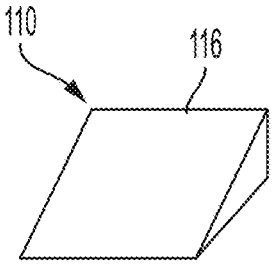
Figure 4C:
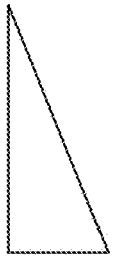
Figure 4D:
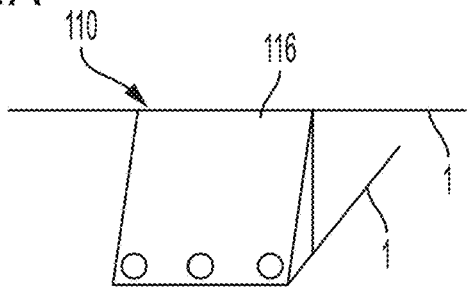
Figure 4E:
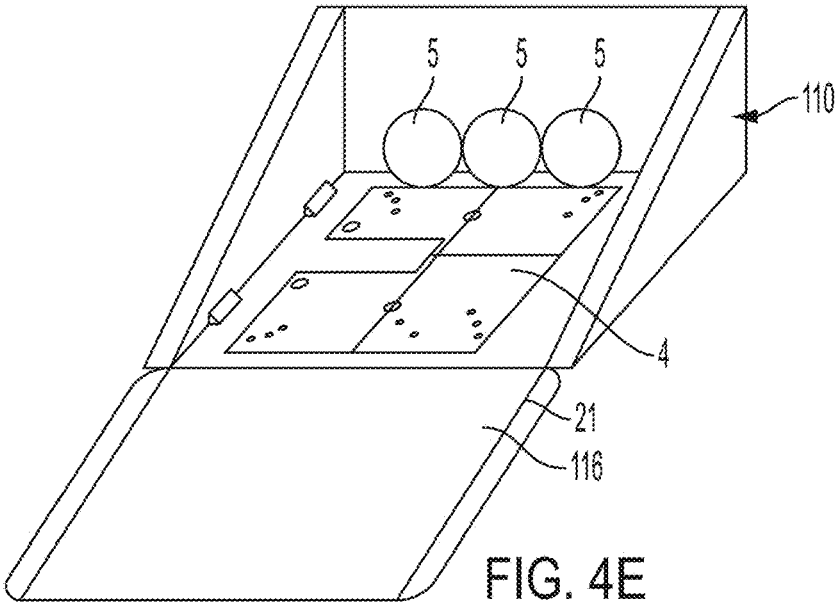

FIGS. 4A-4E show an alternative sized and shaped device 110 made specifically for putting. The device has sides 112, 114, 116 and tabs 118, similar to device 10 There is a top flat view of the device that allows for flat shipping of the device with nothing in it (FIG. 4A). There is an angled front view of the design in closed shipping form (FIG. 4B). There is a side view of the design showing the angles used for the plane board of putting (FIG. 4C). There is a front angled view of the design that shows it in use tight alignment sticks for ball position, plane line, shaft plane, as well as eye position and head movement (FIG. 4D). There is also an image of the design in shipping container form where the device is open and inside there is a putting mirror 4 as well as golf balls to show training aids being shipped and stored in the device (FIG. 4E).

Figure 5A:
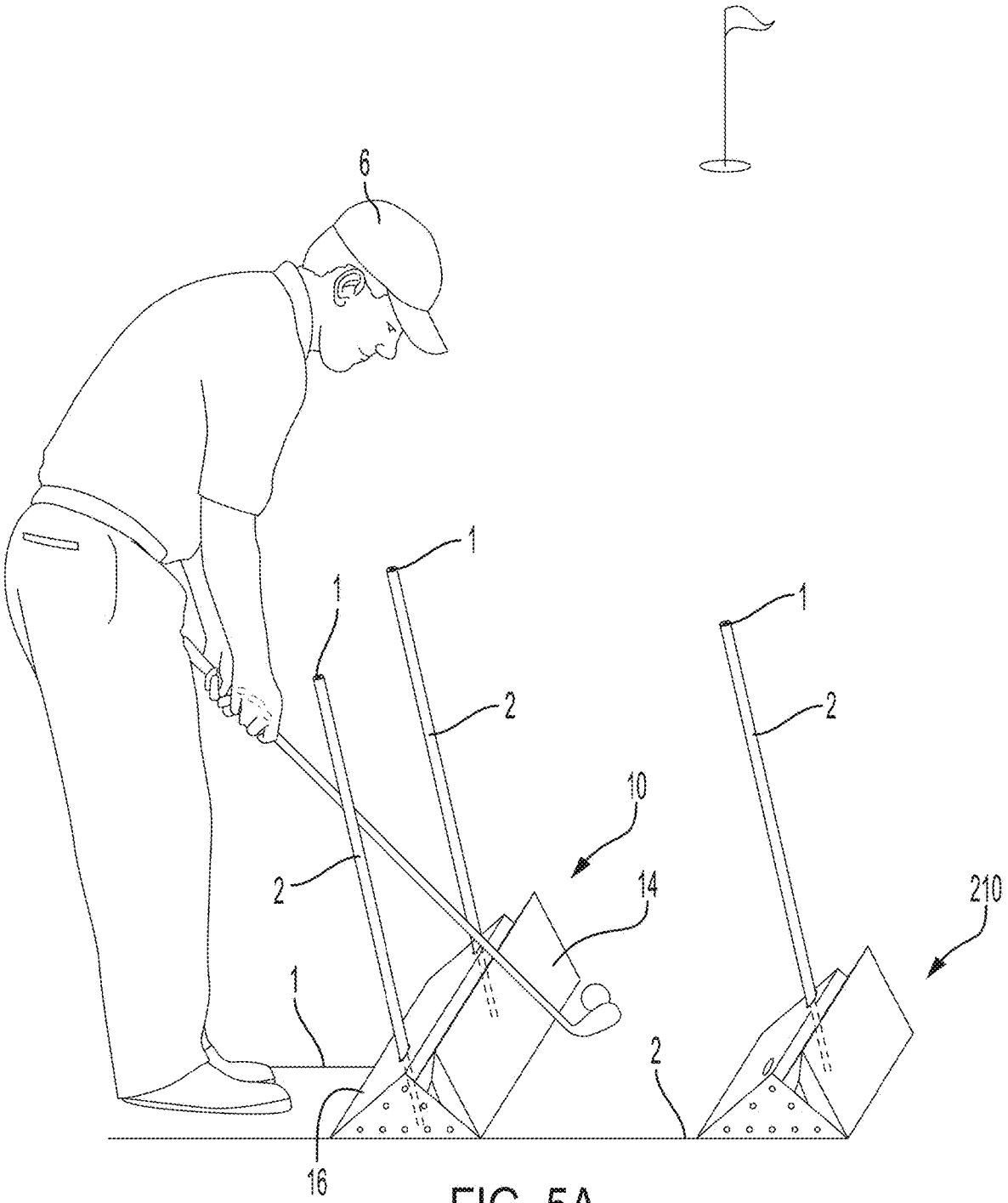
FIGS. 5A-5B show two devices of different sizes being used in combination as a practice station with a plane board, swing slot, and ball position alignment stick.
Figure 5B:
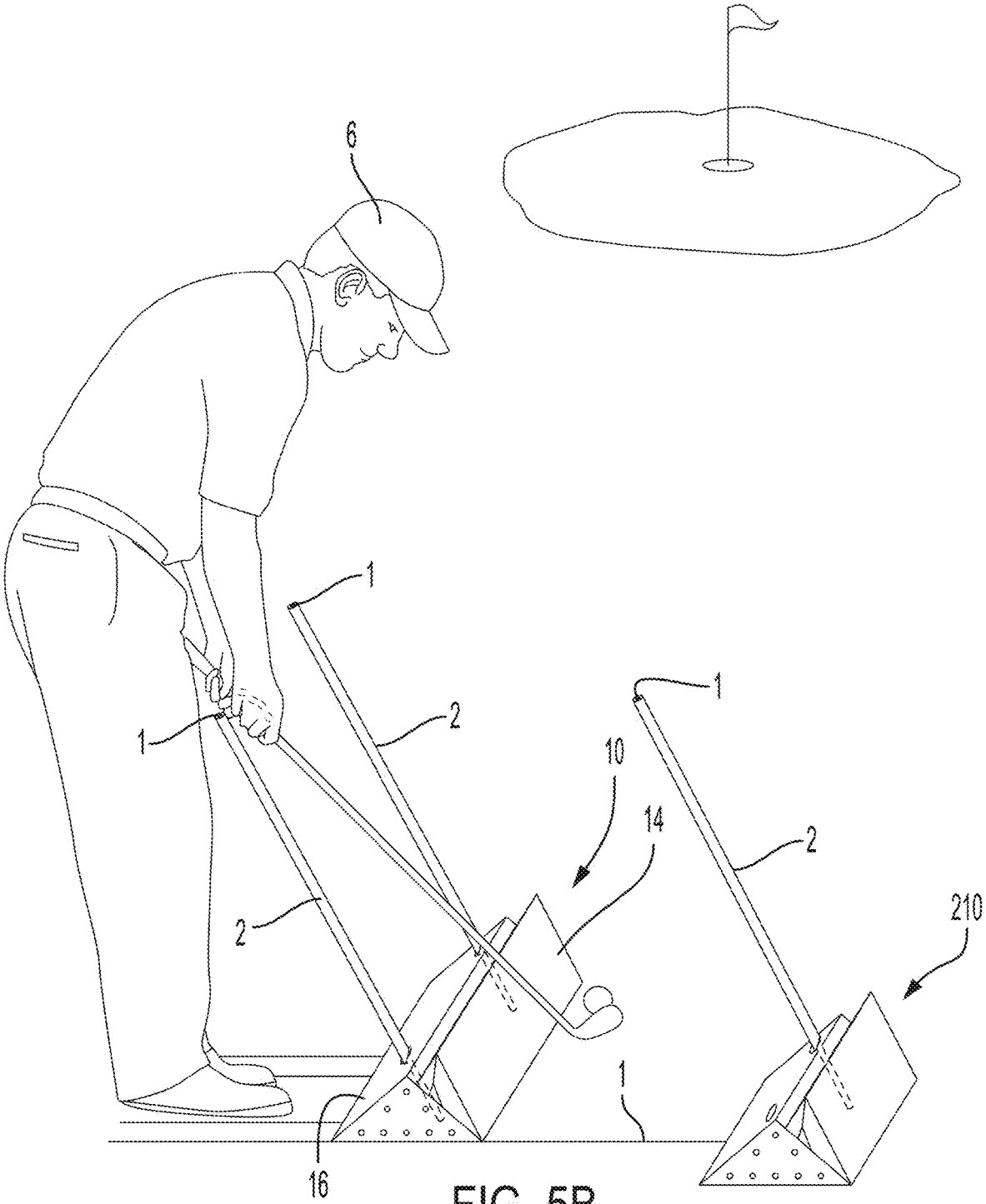

FIGS. 5A-5B shows the device 10 being used by a golfer 6 in a couple of different configurations. The figure on the left (FIG. 5A) is using two attached devices 10, 210 to work on alignment, shaft plane, hand path and ball position with an iron while on the range. The figure on the right (FIG. 5B) is using two attached devices 10, 210 to work on alignment, shaft plane, slot training on the downswing and backswing, ball position, and stance width with a driver while on the golf course. (Device 210 may be the same or similar to device 10.). The devices 10 and 210 may be connected by various structures. For example, they may be connected by an alignment marker 1.

Two different sized devices like devices 10 and 210 may setup together to work on shaft plane, alignments, ball position, downswing and backswing motion, stance width. There are additional holes visible on the device for all other functions including head motion, putting plane, shaft control, club path, eye position at setup, hand plane and all functions described in this document. In FIG. 5A, the devices are shown holding up alignment sticks and foam noodles for a wedge golf swing plane, the angles of the devices are adjusted by using an alignment marker 1.

In FIG. 5B, the devices are shown holding up alignment sticks 1 and foam noodles 2 for an iron golf swing plane, the angles of the devices may be adjusted by using a golf tee, alignment marker, pencil, or other such structure.

Figure 6:
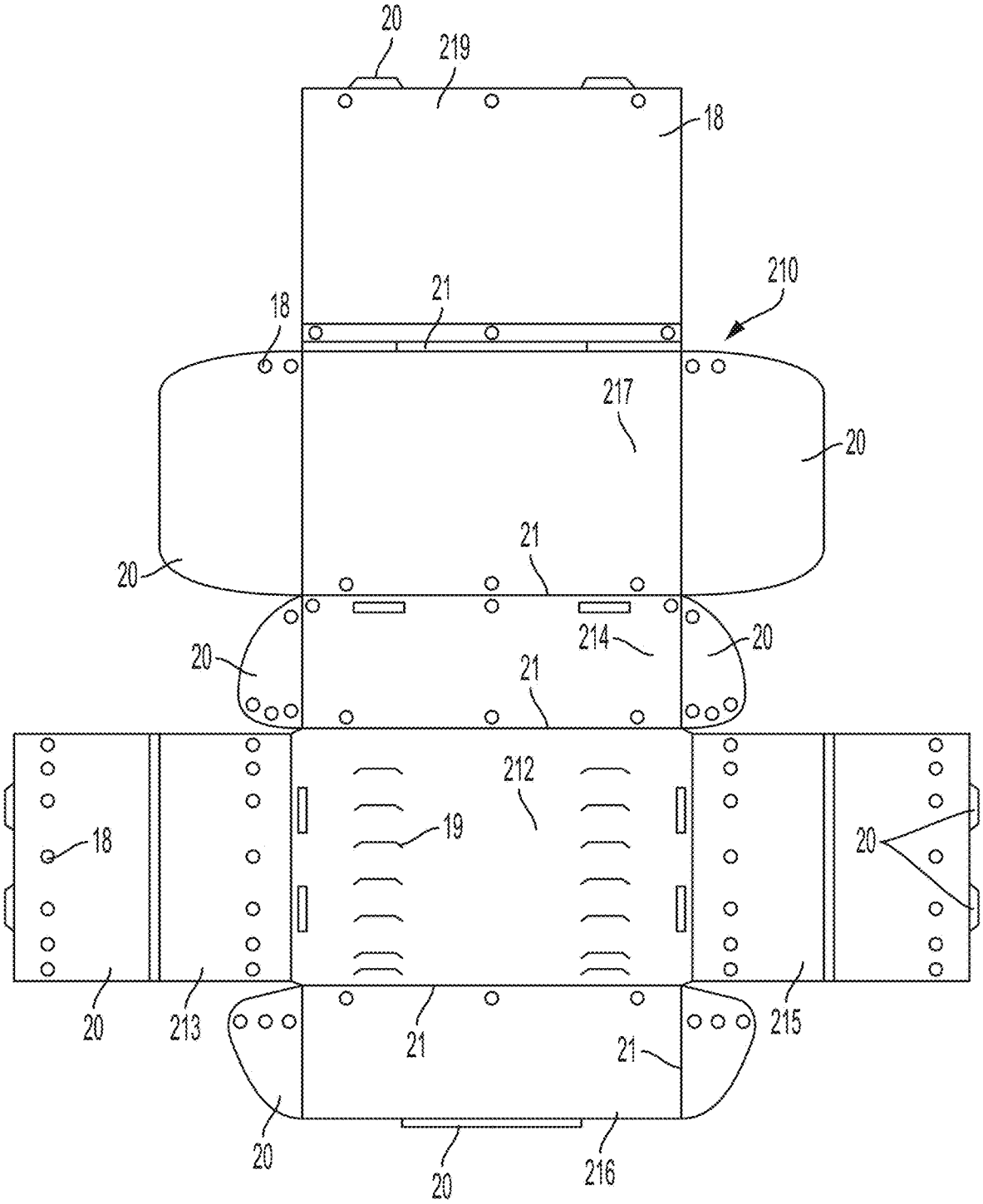
FIG. 6 shows a flat view of device 210 which can be folded and assembled into a rectangular prism shape with six sides.

FIG. 6 shows a flat view of device 210 which can be folded and assembled into a rectangular prism shape with six sides. The device includes six side sections that form the six sides for a rectangular box: bottom section 212, back section 214, front section 216, top section 217, and opposing side sections 213, 215. It includes holes 18 for alignment, ball position, shaft plane, head motion, eye setup, hand path, hip motion, and also cut out tabs 19 used to adjust the varying plane angles of the device. (While multiple holes and cutout tabs are shown, only a single, representative ones are labeled with reference numbers.) An overlap section 219 extending from top section can coextensively be folded over or under top section 217. It includes tabs 20 that can engage with cut-out tabs 19. It therefore can be set to varying angles and serve as a guide plane for club swing like front surface 16 in other embodiments. All sections 212, 214, 215, 216, and 217 have lateral tab sections 20 that can be folded over onto any such section to engage with and/or provide support between or among side sections. (Some tab sections 20 are also shown having their own tab sections 20.) As in other embodiments, in assembled form, device 210 can serve as a shipping container.

Figure 7A:
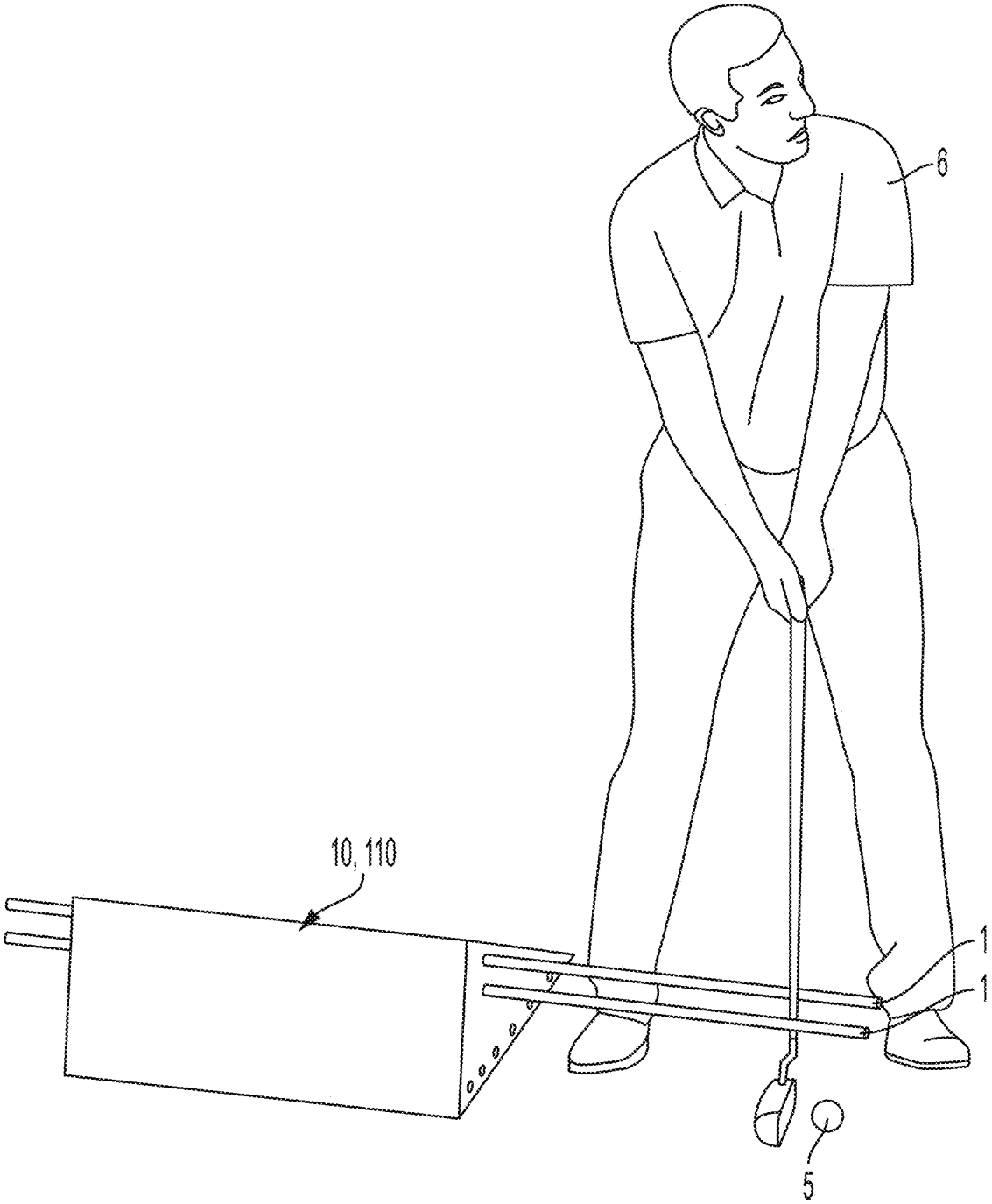
FIGS. 7A-7B show a device setup in with different alignment and swing slot functions.
Figure 7B:
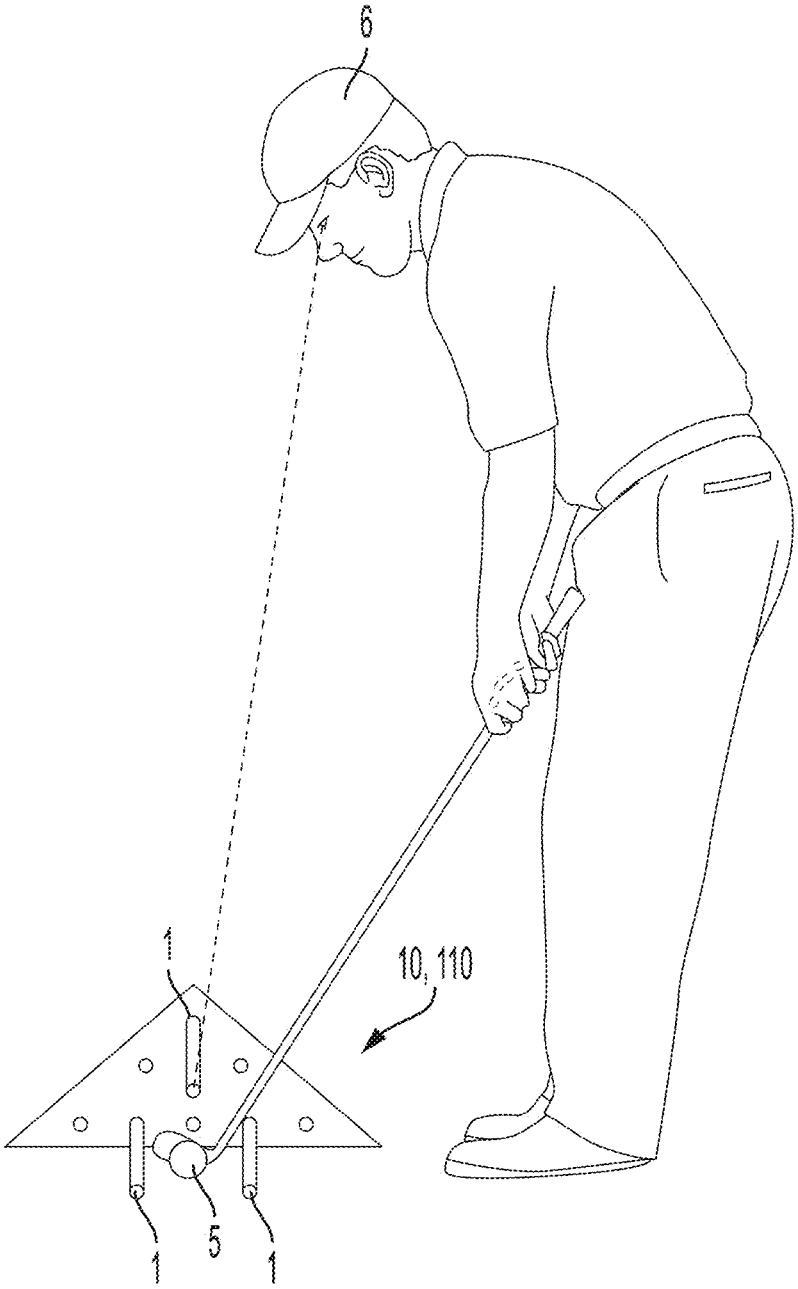

FIGS. 7A-7B show a device like device 10 or 110 configured with alignment sticks 1 in two different ways both designed to work on putting. On the left (FIG. 7A), the golfer can use the alignment sticks to glide his shaft on one of them for path/plane control, as well as keep it between both alignment sticks for the same purpose. This will also aid in setup and alignment. On the right (FIG. 7B), the golfer can use the top alignment stick by putting the ball directly beneath it so that they can tell when their eyes are directly over the ball 5. The other two alignment sticks aid in alignment, path and face control. In this position the device can also aid in limiting the stroke length.

Figure 8A:
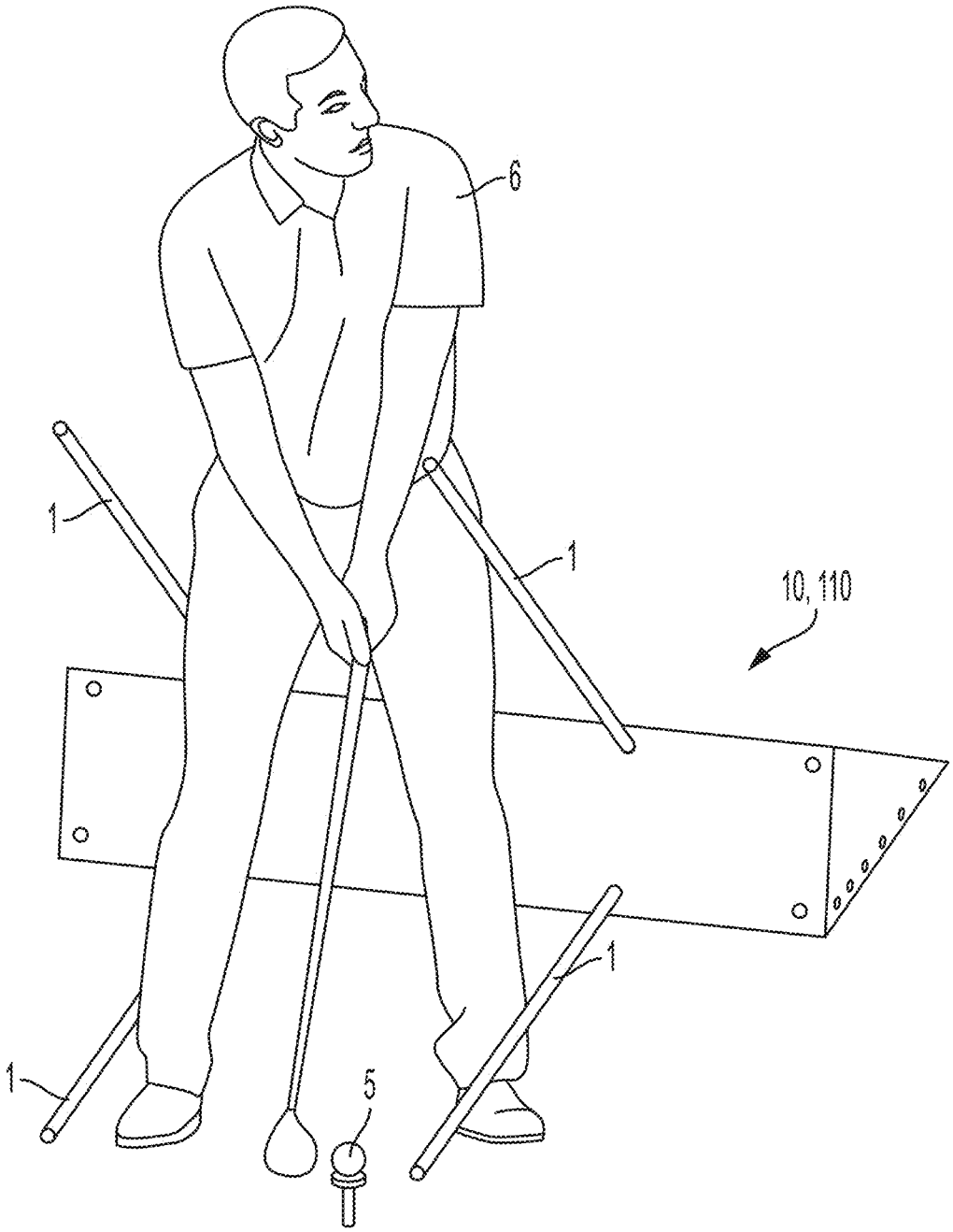
FIGS. 8A-8B show a device like device 10 or 110 configured with alignment sticks 1 in two different ways.
Figure 8B:
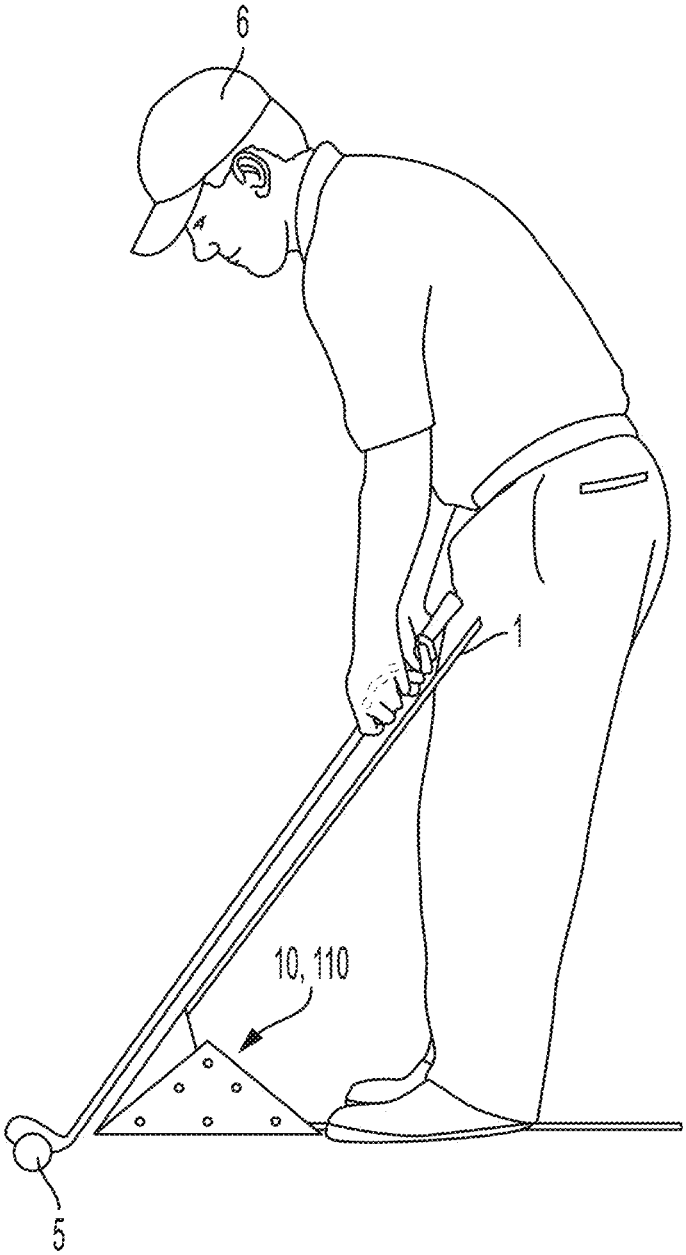

FIGS. 8A-8B show a device like device 10 or 110 configured with alignment sticks 1 in two different ways. The image on the left (FIG. 8A) shows the golfer using the device to hold alignment sticks on either side of his lower body to show them how their body is moving throughout the swing, additionally they are using the two lower alignment sticks to help with ball 5 position and stance width. The image on the right (FIG. 8B), shows the golfer using the device to work on the plane of his setup, takeaway and over all swing motion with an iron. As well, they have alignment sticks at ground level for ball position and stance width.

Figure 9A:
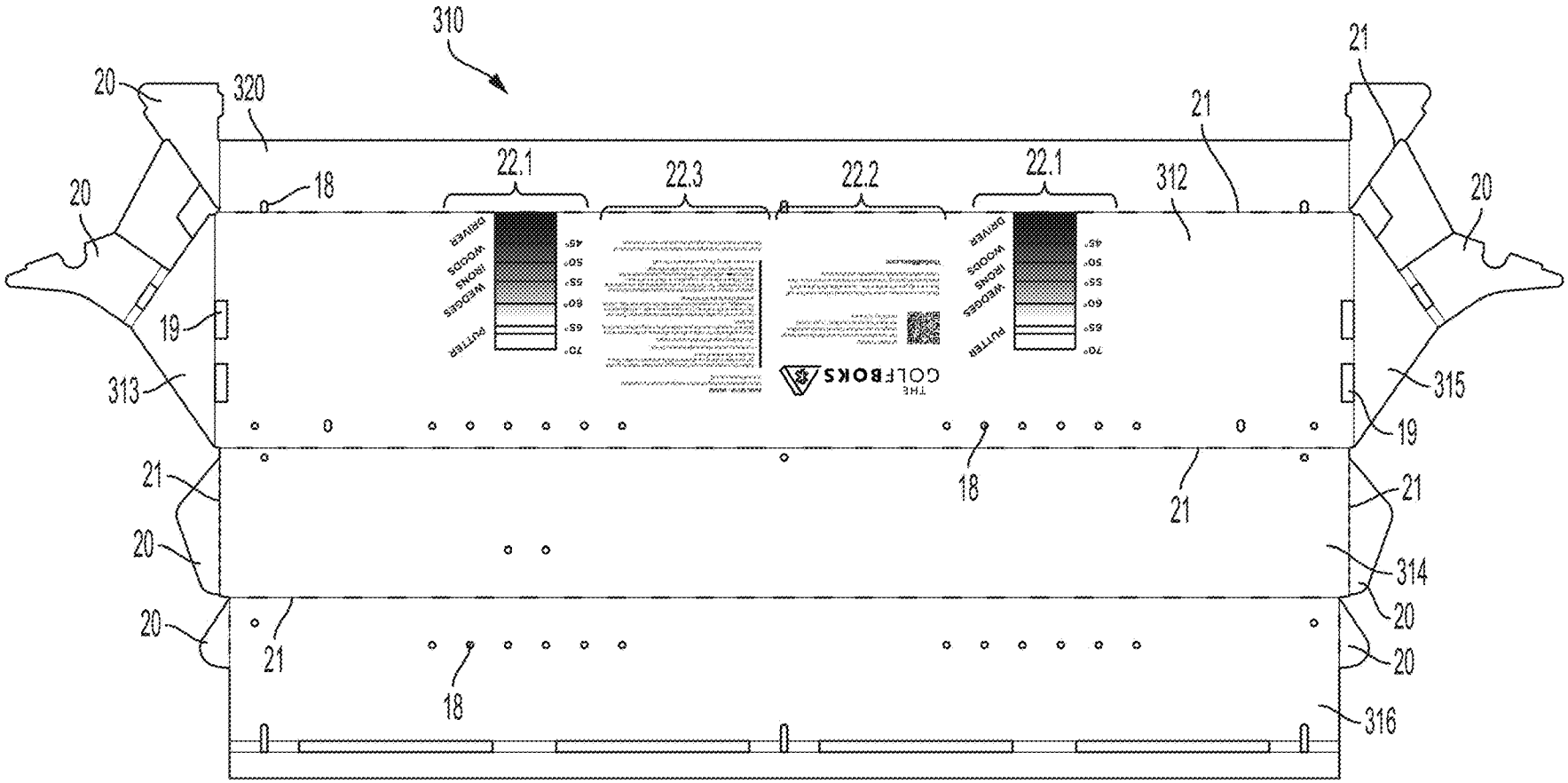
FIGS. 9A-9D show another embodiment of a device with a triangular prism form and various graphic elements, in flat and folded forms.
Figure 9B:
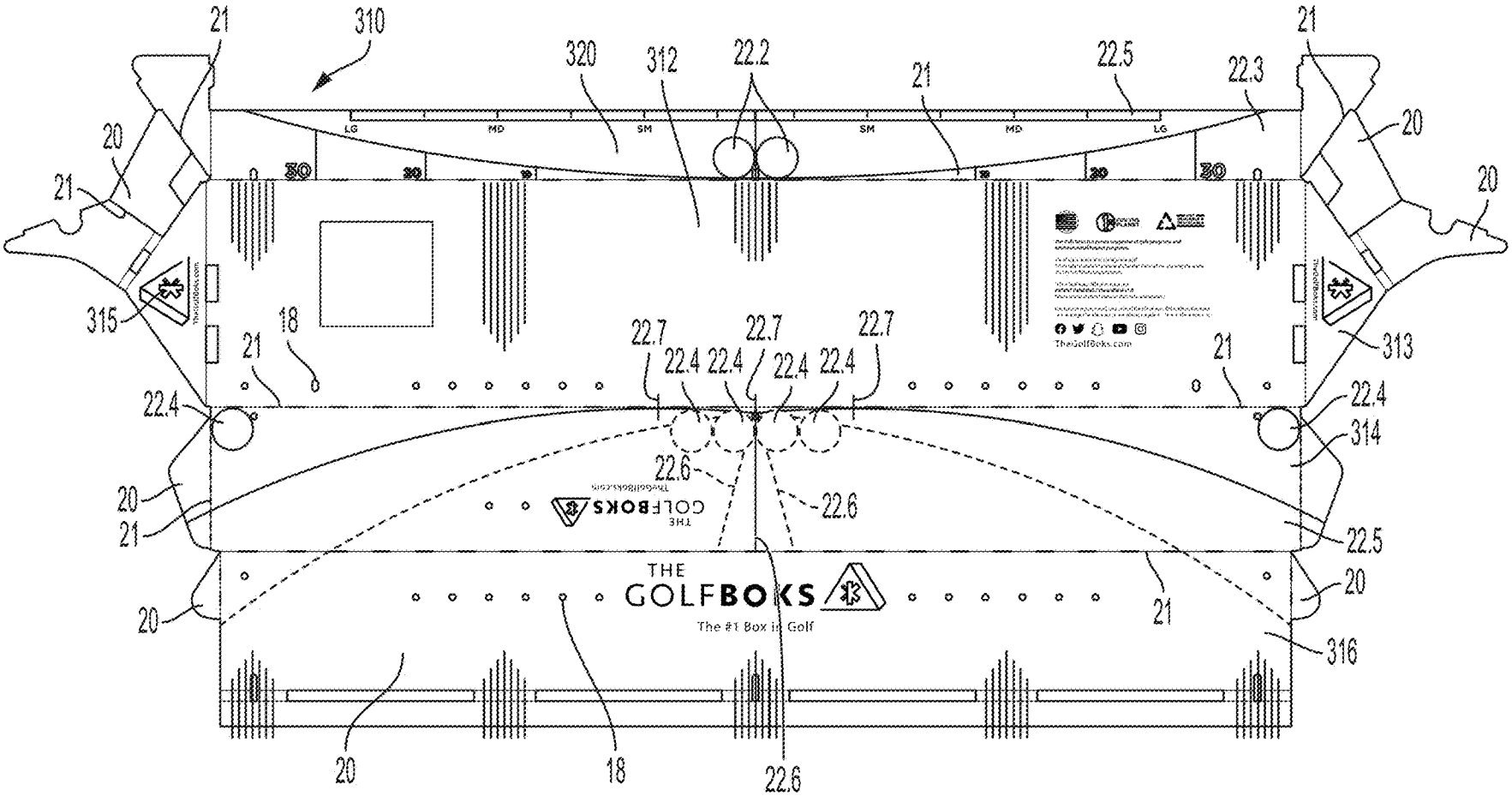
Figure 9C:
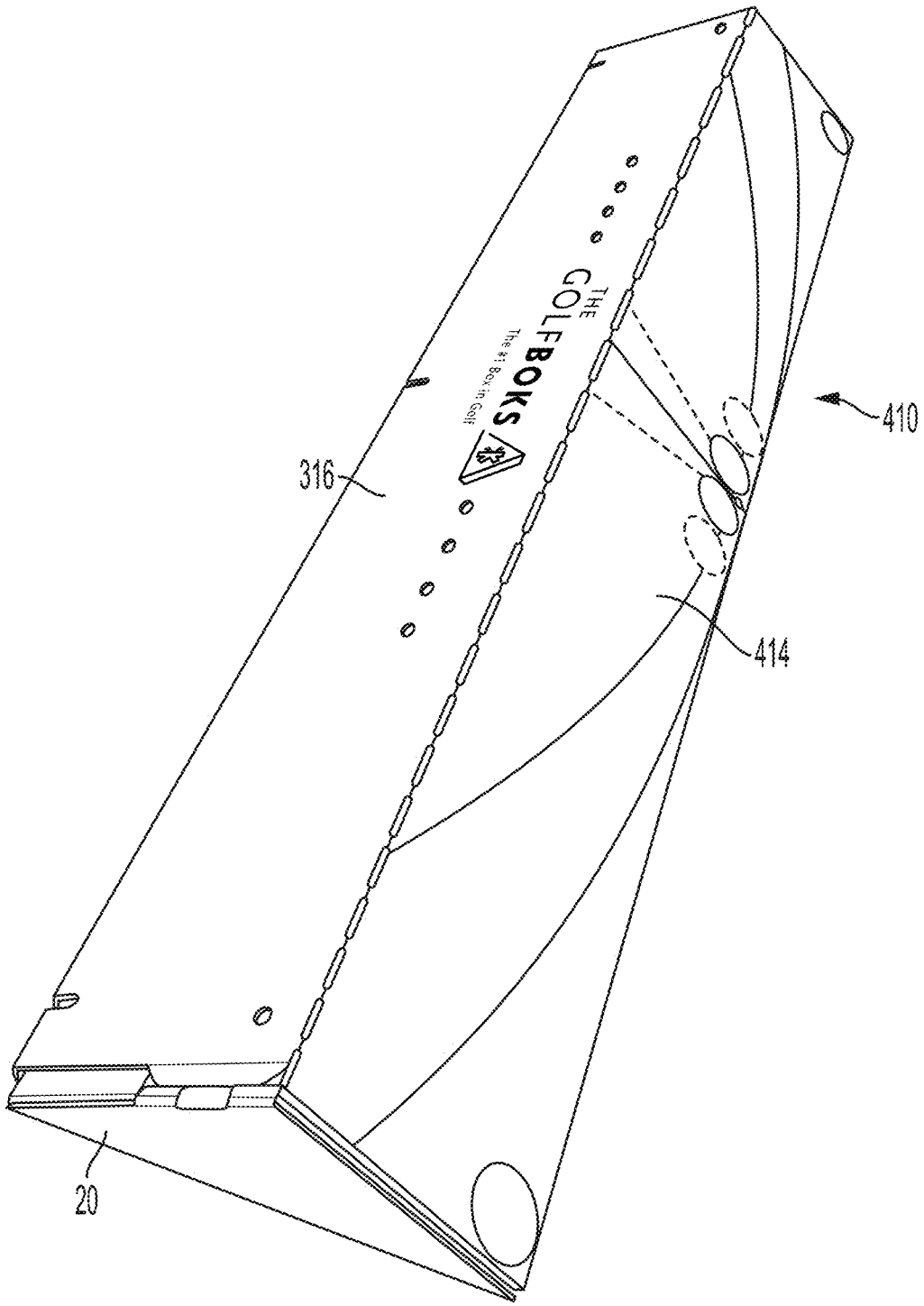
Figure 9D:
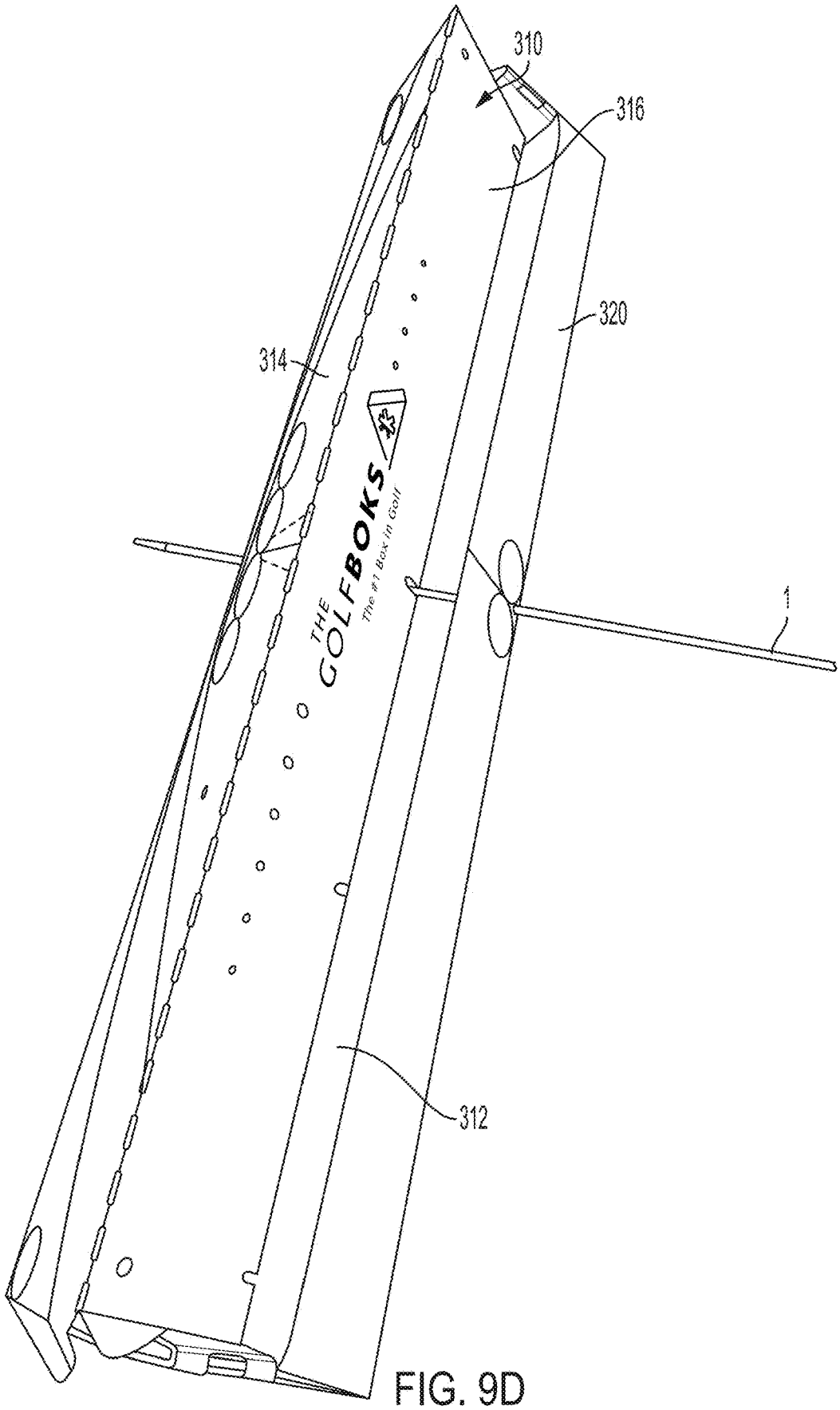

FIGS. 9A-9D show top and bottom flat views (FIG. 9A-9B) of device 310 which can be folded and assembled into a triangular prism shape (FIG. 9C) with five sides, and which can have a front section 316 that can be placed at selected angles (e.g., FIG. 9D).

Looking at the device in more detail, it includes five side sections that form the five sides for a triangular prism box: bottom section 312, back section 314, front section 316, and opposing side sections 313, 315. It includes holes 18 for alignment, ball position, shaft plane, head motion, eye setup, hand path, hip motion, and also cut out tabs 19 used to adjust the varying plane angles of the device. (While multiple holes and cutout tabs are shown, only a single, representative ones are labeled with reference numbers.) An overlap section 219 extending from top section can coextensively be folded over or under top section 217. It includes tabs 18 that can engage with cut-out tabs 18. It therefore can be set to varying angles and serve as a guide plane for club swing like front side surface 16 in other embodiments. All sections 212, 214, 215, 216, and 217 have lateral tab sections 18 that can be folded over onto any such section to engage with and/or provide support between or among side sections. As in other embodiments, in assembled form, device 210 can serve as a shipping container.

FIG. 9A shows interior surfaces, and FIG. 9B shows exterior surfaces. Each of the interior and exterior surfaces include graphic elements. The graphic elements 22 may be used as setup elements for setting the configuration of the device, instructional elements for instructing on use of the device, promotional elements for promoting a product or service, QR codes that link to online sources of information related to the device or golf, etc.

Looking first at the interior surface of device 310, bottom side section includes a graphic element in the nature of a chart 22.1 showing a range of angles for setting front side section 316, depending on the type of golf club is to be used. It shows the front side section angle settings for drivers at 45 degrees or less, woods at 45-50 degrees, irons 50-55 degrees, wedges 55-60 degrees and putters at 60-65 or 65-70 degrees. Naturally, there may be a few degrees of variance around any of the end points in a range. A golf tee, alignment marker or other such structure may be placed through bottom side section 312 or through front side section 316 and through bottom side section 312 to fix the front surface to a particular zone, by landing one end of the structure into a desired angle on the chart 22.1. Graphic element 22.2 includes a QR code, web address and information on using the device. Graphic 22.3 includes basic instructions on setting up and using the device.

Looking now at the exterior surface of device 310, extending from bottom section 312 is a widthwise tab 320 that fold upwardly. Front side section overlaps with tab 320 in the container configuration. In the use configuration, the front side section 316 can fold behind tab 312, as seen in FIG. 9D, with a leading edge being arrangeable on chart 22.1 to set the front side section at a desired angle as discussed above. With the front side section set behind tab 320, graphic elements can be viewed on the tab. Tab 320 includes graphic element 22.3 which is a concave curve that has a tangent with the front edge of bottom side section 312 at the center of the device. On either side of that central point, the curve rises upwardly to about the sides of the device. The curve defines a path for club head to swing. The graphic element 22.3 includes silhouettes of golf balls as reference points 22.4 for placing balls. The reference points are adjacent the center line of the device. The graphic element 22.3 also includes a set of gradations, namely spaced, numbered vertical lines in the curved area to indicate range of club stroke for putting a particular distance. The numbers 10, 20, 30 and 40 indicate putt distances in feet.

Tab 320 also includes graphic element 22.5 in the nature of a horizontal bar with gradations in the nature of vertical lines marked on either side of the center line of the device with SM (small), MD, (medium), LG (large). These gradations indicate a range foot positions for a golf stance.

Back side section 314 also may include graphic elements. In this embodiment, graphic element 22.5 is a concave curved area that indicates a desired curve zone for a club head to swing within. Also include on back side section are a set of lines 22.6 that define different shaft angles that may be desired, as well as more ball placement reference points 224. There are three reference lines, the middle being for shaft alignment at setup and the outer lines representing different shaft angles on club-ball impact. There are also tick marks 22.7 for where the club head should hit the ground.

Figure 10A:
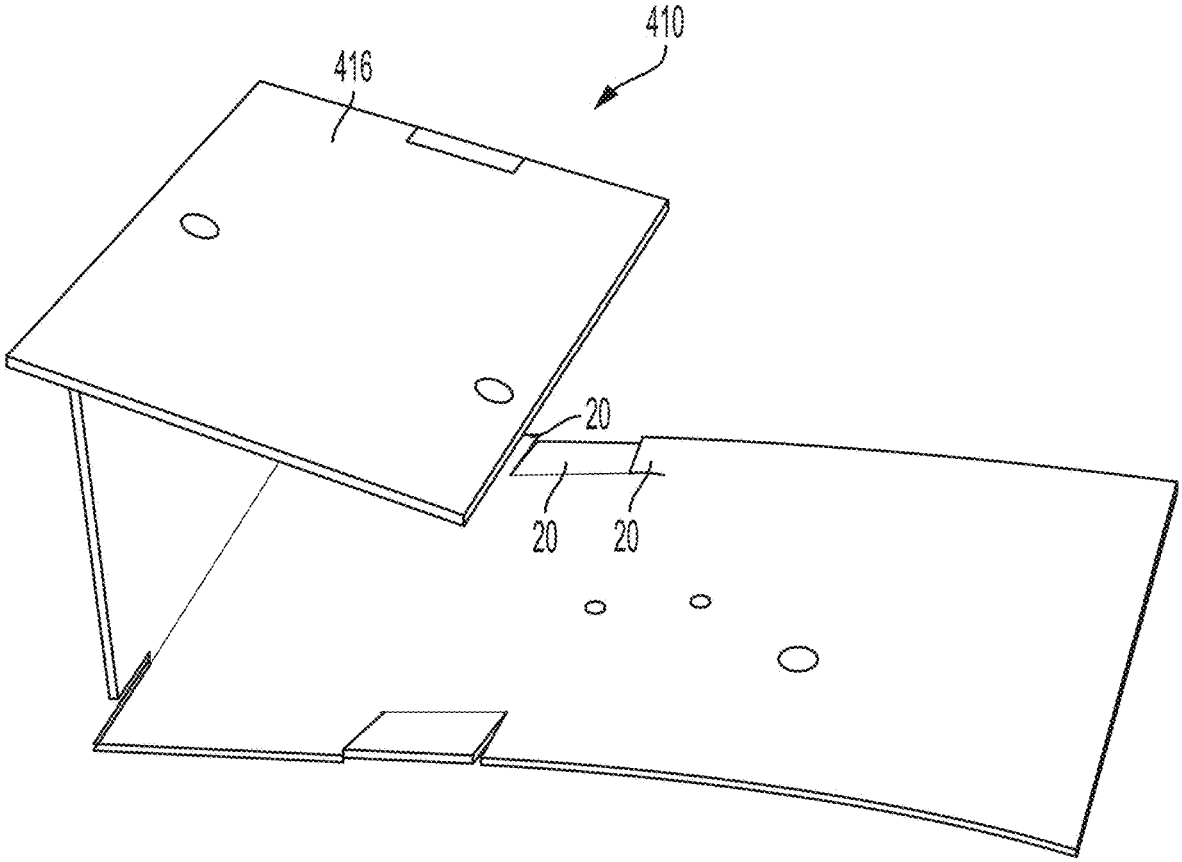
FIGS. 10A-10B show a small-scale device with integrated engageable elements for setting the angle of a side section of the device.
Figure 10B:
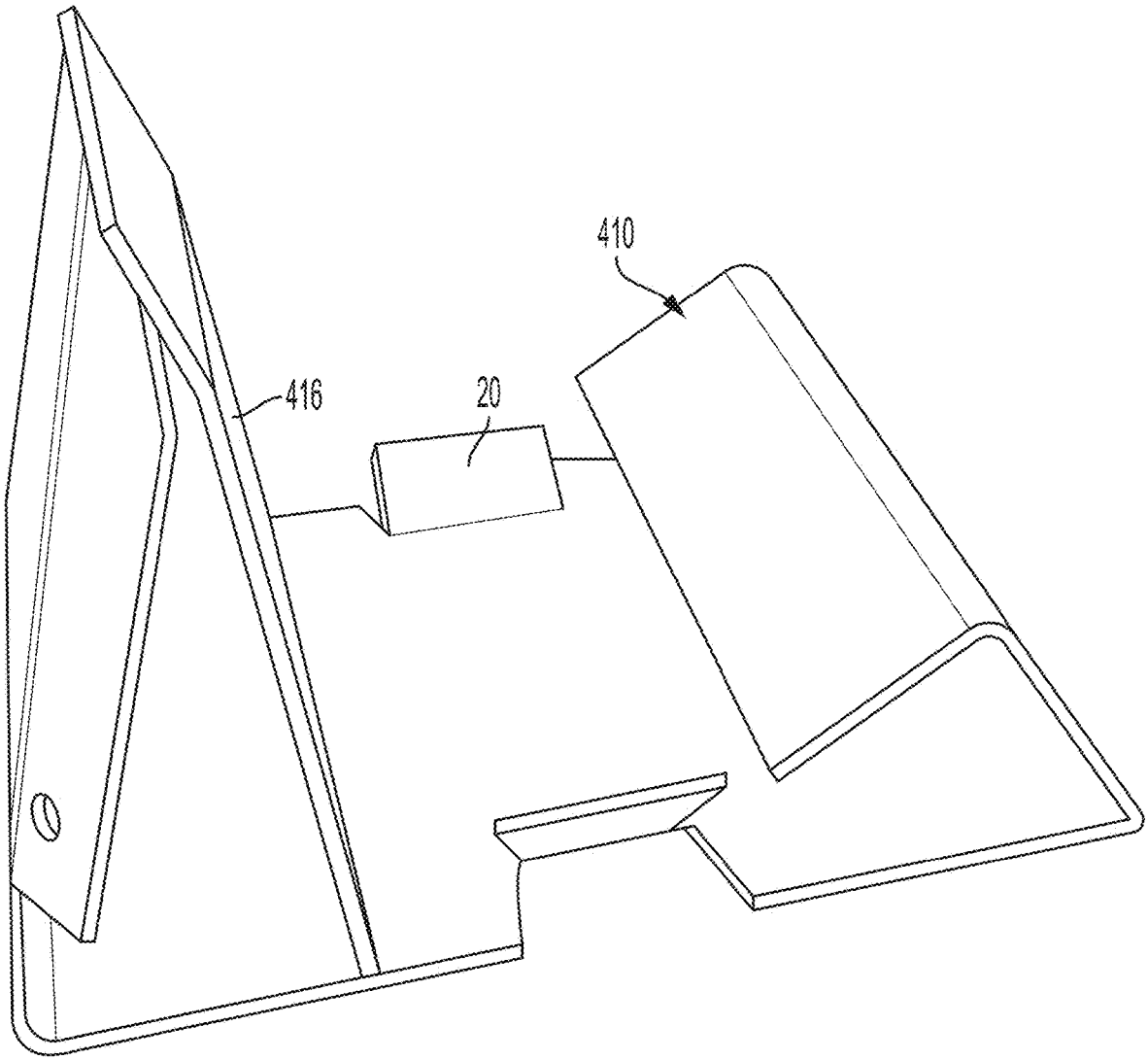
Figure 11:
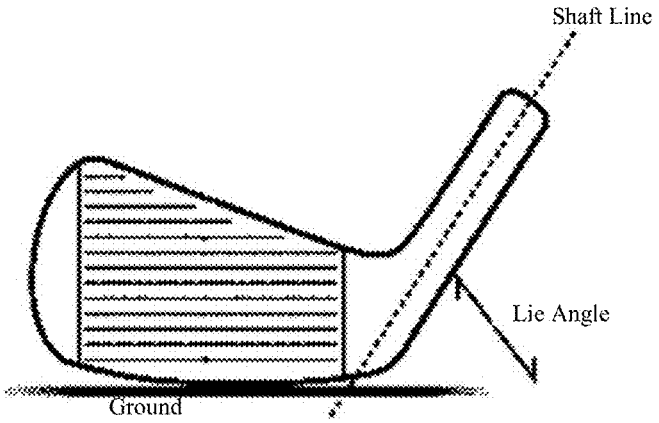
FIG. 11 shows a standard lie angle for a golf club.

FIGS. 10A-10B show a small-scale device 410 that is similar to other devices disclosed herein but is relatively smaller. The device may be relatively short (e.g., between 18 to 6 inches or less than 18 inches, 16 inches, 14 inches, 12 inches, 10 inches, 8 inches, or 6 inches) compared to other embodiments. This device includes tabs 20 that can be folded up to set the front side section 416 at a selected angle. The device can be included as a cut-out pattern in a larger sheet of material. The larger sheet of material could have partial cut-out to facilitate removal from the larger sheet.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

What is claimed:

1. A golf training device comprising:

a planar element that is formable into a predetermined 3D container form using two or more respective sets of crease or fold lines associated with the planar element, the crease lines defining at least three sides so that the folded device is formable into a container, at least one side being a plane face;

one or more support means for supporting one or more alignment sticks or markers, the support means arranged to orient the alignment marker or stick in position useful for golf training;

a plurality of graphic elements disposed on the planar element that represent two or more of; ball position, shaft lean, stroke length, angle of attach, and club path; and wherein the support means comprises fully or partially formed holes in the planar element.

2. The device of claim 1 wherein the support means comprises fully or partially formed holes in the planar element.

3. The device of claim 1 wherein the device includes graphic elements, comprising at least two or more of: a range of angles for setting the plane face, depending on the type of golf club is to be used; golf ball silhouettes for placing balls; a set of gradations, namely spaced, numbered vertical lines in a curved area to indicate range of club stroke for putting a particular distance; a horizontal bar with gradations in the nature of vertical lines marked on either side of the center line of the device, the gradations indicating a range foot positions for a golf stance; a concave curved area that indicates a desired curve zone for a club head to swing within; a set of lines that define different shaft angles.

4. The device of claim 1 wherein the device is adjustably formed from the planar element into a 3D container form so that it is convertible back into the planar element when desired.

5. The device of claim 1 wherein the planar element comprises cardboard.

6. The device of claim 1 wherein the device is configured to serve as a shipping container as well as a golf training aid, the device including crease lines that define side end closures for the container.

7. The device of claim 6 further comprising an item of merchandise.

8. The device of claim 7 wherein the item of merchandise comprises a golf alignment marker or stick.

9. The device of claim 7 wherein the merchandise further comprises a hollow foam noodle sized to fit over the alignment marker.

10. The device of claim 1 wherein the 3D form is a prism shape.

11. The device of claim 1 wherein one or more engageable elements hold the device in the predetermined 3D container form.

12. The device of claim 11 wherein the engagement elements comprise tabs or flaps that securingly engage with other surfaces in the device.

13. A system comprising two or more devices according to claim 1 connected together.

14. A golf training device comprising:

a planar element that is formable into a predetermined 3D container form using two or more respective sets of crease or fold lines associated with the planar element, the crease lines defining at least three sides so that the folded device is formable into a container, at least one side being a plane face;

wherein the plane face is adjustable into a plurality of predetermined plane angles;

and a plurality of holes that are sized, shaped, and arranged to fixedly receive and hold an alignment stick in one or more desired positions used in golf training; and wherein the device is configured to support the alignment sticks or markers at a plurality of static lie angles between 35 to 80 degrees.

15. A golf training device comprising:

a planar element that is formable into two or more predetermined 3D forms using two or more respective sets of crease or fold lines associated with the planar element the fold lines defining two or more sections in the planar element, at least one section being a plane face with an adjustable angle;

one or more support means for supporting one or more alignment sticks or markers, the support means arranged to orient the alignment marker or stick in position useful for golf training; and wherein one or more engageable element associated with one or more sections of the planar element adjustably hold the predetermined 3D forms and allow for adjustment of the angle of the plane face; and wherein the engageable elements comprise tabs or flaps that securingly engage with one or more sections of the planar element in the device.

16. The device of claim 15 wherein the engageable elements comprise tabs or flaps that securingly engage with one or more sections of the planar element in the device.

17. The device of claim 15 wherein the device includes graphics indicative of a golf parameter, comprising one or more of ball position, shaft lean, putting stroke length, club path, angle of attack, instruction on how to use the device, angles to use for different ball flights, and which angles to use for different clubs.

18. The device according to claim 15 wherein the device is configured to support alignment sticks or markers at a plurality of static lie angles between 35 to 80 degrees.

19. The device of claim 15 wherein at least one form has at least three sides defined by the crease lines, and the sides are formed into a container enclosing an item of merchandise.

* * * * *